US006296500B1

(12) United States Patent
Liao

(10) Patent No.: US 6,296,500 B1
(45) Date of Patent: Oct. 2, 2001

(54) ELECTRICAL CARD CONNECTOR HAVING A SWITCH DEVICE

(75) Inventor: Chih-Yuan Liao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/548,704

(22) Filed: Apr. 13, 2000

(51) Int. Cl.[7] ..... H01R 29/00
(52) U.S. Cl. ..... 439/188; 439/489
(58) Field of Search ..... 439/188, 630, 439/489; 235/441

(56) References Cited

U.S. PATENT DOCUMENTS 4,900,272 * 2/1990 Chang ..... 439/188
5,334,034 * 8/1994 Reichardt et al. ..... 439/188
5,369,259 * 11/1994 Bleier et al. ..... 235/441
5,370,544 * 12/1994 Reichardt et al. ..... 439/188
5,667,397 * 9/1997 Broschard, III et al. ..... 439/188
5,775,937 * 7/1998 Bricaud et al. ..... 439/188
5,911,587 * 6/1999 Vermeersch ..... 439/188
5,924,881 * 7/1999 Yasushi et al. ..... 439/188
6,004,155 * 12/1999 Wu ..... 439/188
6,015,311 * 1/2000 Benjamin et al. ..... 439/188
6,073,853 * 6/2000 Odic ..... 439/188
6,099,335 * 8/2000 Chang ..... 439/188
6,120,310 * 9/2000 Chang ..... 439/188

* cited by examiner

*Primary Examiner*—Gary F. Paumen
(74) *Attorney, Agent, or Firm*—Wei Te Chung

(57) ABSTRACT

An electrical card connector includes an insulative housing, a plurality of contacts fixed in the housing and a switch device. The housing defines a plurality of contact receiving passageways for receiving the corresponding contacts therein, and switch receiving cavities for accommodating the switch device therein. The switch device has a pair of identical switch terminals and a bridge member for establishing electrical connection between the pair of switch terminals. The switch device can be pre-designed either to be normally open or to be normally closed. When an electrical card is inserted into the electrical card connector, the switch terminals disengage from or engage with the bridge member, opening or closing a corresponding electrical circuit in switch circuitry.

7 Claims, 8 Drawing Sheets

ELECTRICAL CARD CONNECTOR HAVING A SWITCH DEVICE

FIELD OF THE INVENTION

The present invention relates to an electrical card connector, and particularly to an electrical card connector having a simple switch device performing a prompt and effective switch function thereof.

BACKGROUND OF THE INVENTION

An electrical card connector commonly has a switch device for indicating whether an electrical card is inserted therein. The switch device usually employs a stationary terminal and a moveable terminal which is pre-designed to be open or closed relative to the stationary terminal. When an electrical card is inserted into the card connector, the moveable terminal will be forced by the electrical card to electrically engage with or disengage from the stationary terminal thereby indicating the presence of the electrical card. Pertinent prior art U.S. Pat. Nos. 4,900,272; 5,369,259; 5,370,544, 5,334,034 and 6,004,155 disclose some related designs.

However, such conventional switch devices have several disadvantages. Firstly, the moveable and stationary terminals of the conventional switch devices have different configurations suited to achieve their moveable or stationary functions, which inevitably results in a more complicated manufacturing process and hence higher cost. Secondly, high precision when positioning the moveable and stationary contacts to ensure that the moveable terminal properly contacts the stationary terminal, thus increasing cost of assembly. Thirdly, additional positioning structures are required to be formed on a housing of the card connector to help position the moveable and stationary terminals. In addition, different arrangements of the moveable and stationary terminals are necessary according to the normally open or normally closed configuration of the switch device, which also complicates manufacture and increases costs of the connector.

BRIEF SUMMARY OF THE INVENTION

A main object of the present invention is to provide an electrical card connector having a reliable switch device which is easy to fabricate and assemble.

Another object of the present invention is to provide an electrical card connector with a simple structure allowing the connector to be easily manufactured and assembled.

An electrical card connector in accordance with the present invention includes an insulative housing, a plurality of contacts fixed in the housing and a switch device. The housing defines a plurality of contact receiving passageways for receiving the corresponding contacts therein, and a switch receiving cavity for accommodating the switch device therein. The switch device has a pair of identical switch terminals and a bridge member for establishing electrical connections between the pair of switch terminals. The pair of switch terminals of the switch device can be pre-designed either to be normally open or to be normally closed. When an electrical card is inserted into the electrical card connector forcing the switch terminals to disengage from or come into electrical contact with the bridge member, a corresponding circuit is opened or closed in switch circuitry which indicates that the card is inserted in the connector.

Other objects, advantages and novel features of the invention will become more apparent from the following detailed description when taken in conjunction with the accompanying drawings.

DETAILED DESCRIPTION OF THE INVENTION

Figure 1:
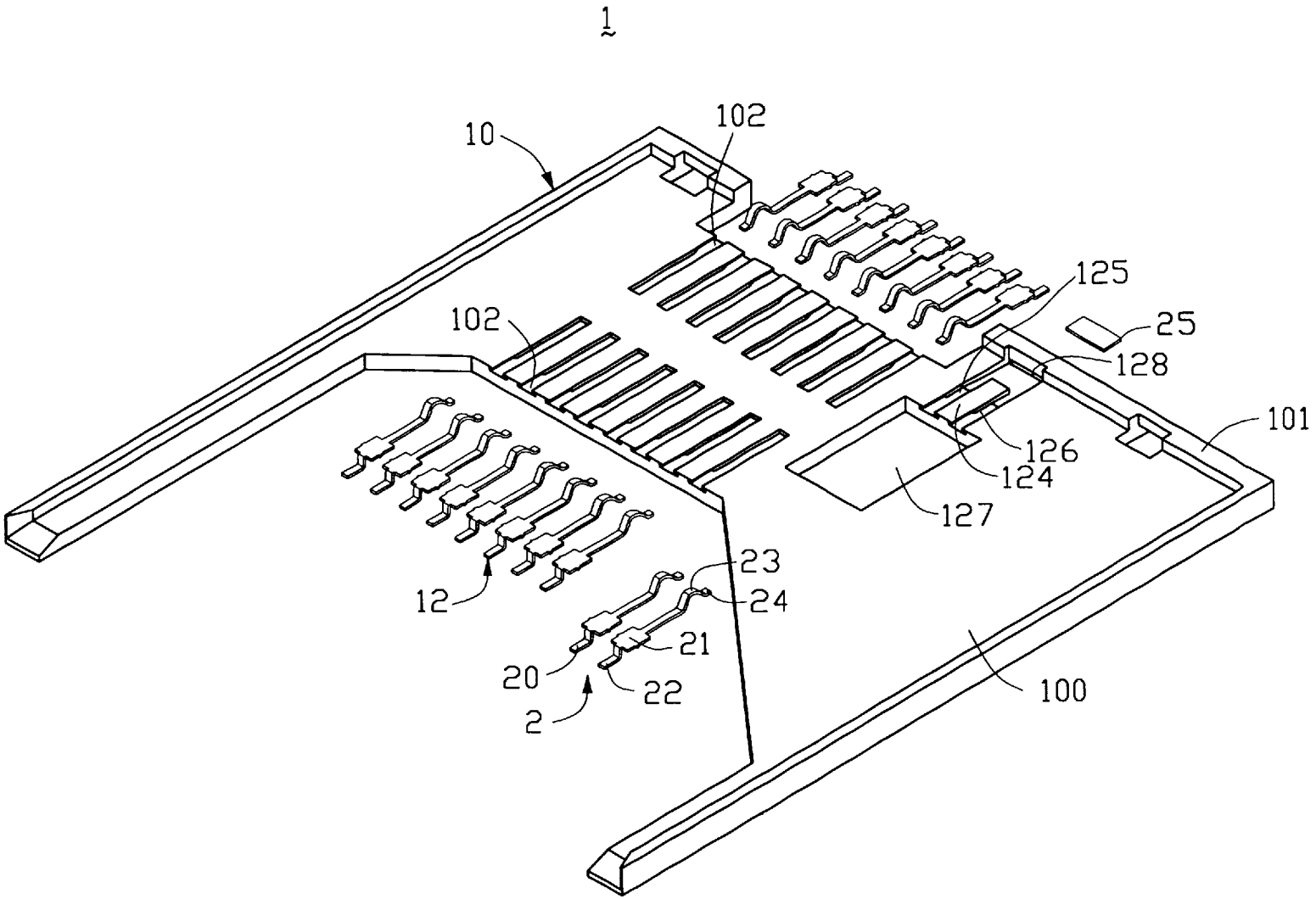
FIG. 1 is an exploded view of a card connector in accordance with a first embodiment of the present invention.
Figure 2:
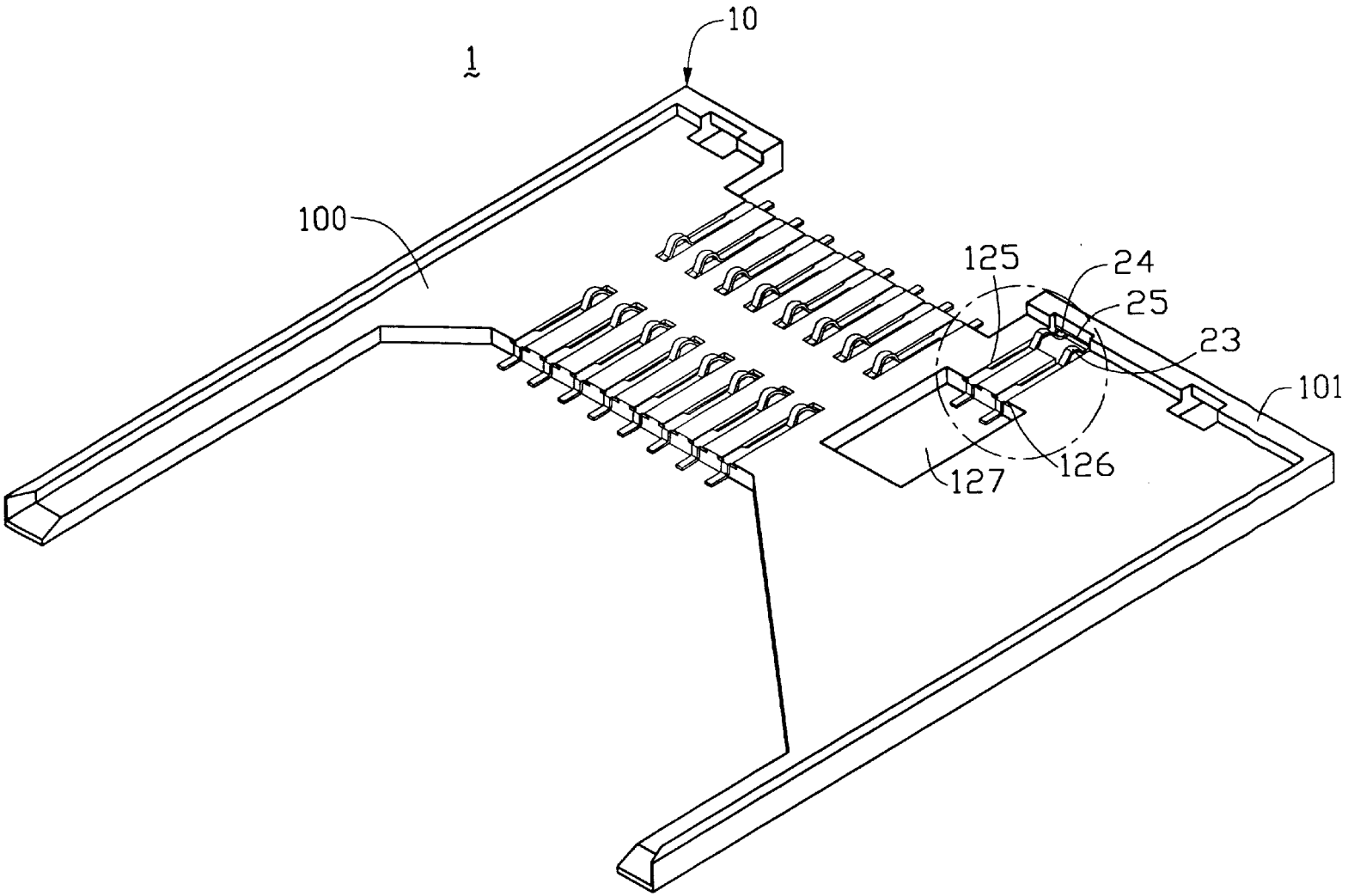
FIG. 2 is an assembled view of FIG. 1.
Figure 3:
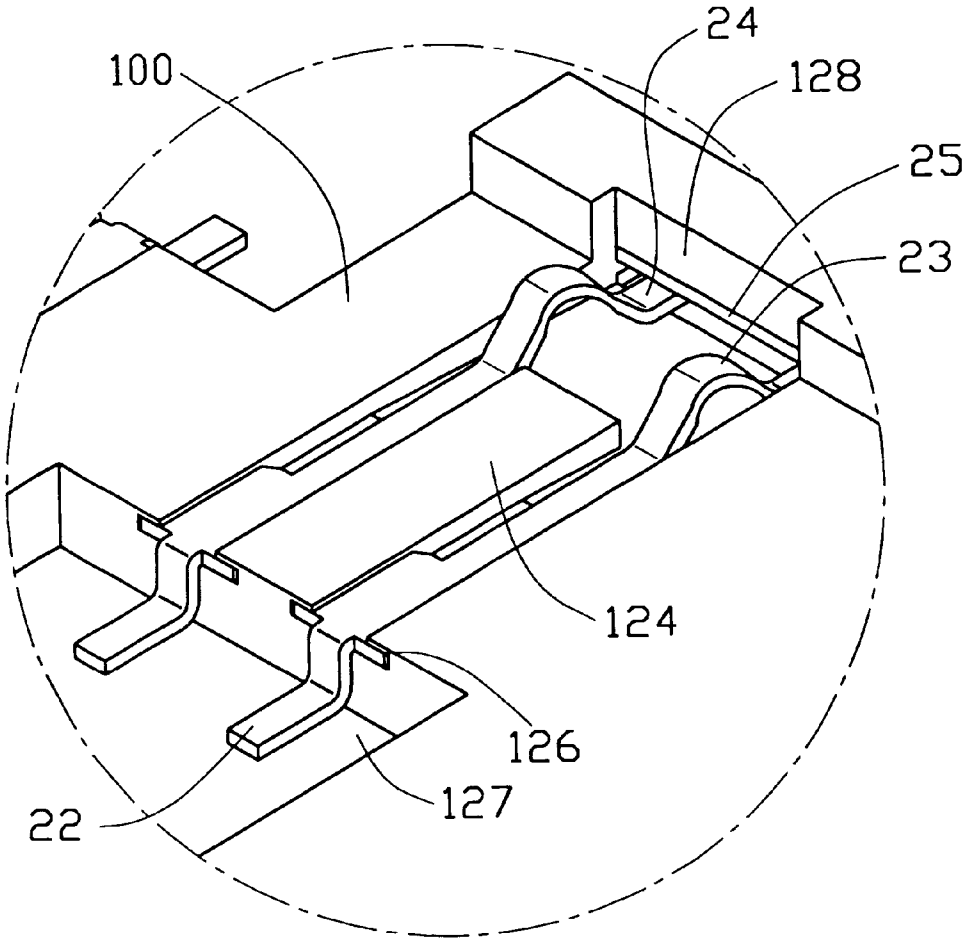
FIG. 3 is a partially enlarged view of a switch device of FIG. 1.
Figure 4:
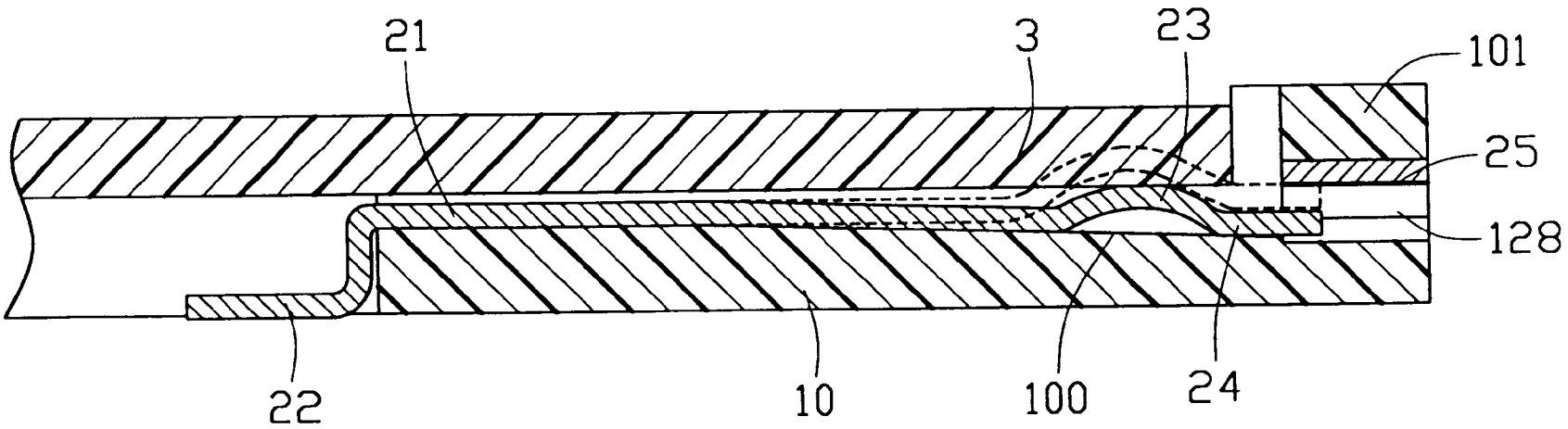
FIG. 4 is a partial cross-sectional view of FIG. 2 showing the switch device engaging with an electrical card inserted into the card connector.

FIGS. 1–4 show a preferred first embodiment in accordance with the present invention. An electrical card connector 1 of the present invention includes an insulative housing 10, a plurality of contacts 12 fixed in the housing 10 and a switch device 2. Each contact 12 is of a conventional design and description thereof will be omitted herewith.

The housing 10 defines a plurality of contact receiving passageways 102 in a base plate 100 for receiving the corresponding contacts 12 therein, and a pair of juxtaposed switch receiving cavities 125, 126 located at an end of the housing 10 for accommodating two identical switch terminals 20 therein. A partition 124 is formed between the two switch receiving cavities 125, 126 for electrically isolating the two switch terminals 20. A rectangular aperture 127 is defined in the base plate 100 in communication with the switch receiving cavities 125, 126. A recess 128 is defined in a bottom face of an end wall 101 of the housing 10 opposite the aperture 127 in communication with the switch receiving cavities 125, 126. Other structures of the card connector 1 are well known by those skilled in the art; thus, detailed description thereof are omitted.

The switch device 2 comprises the pair o switch terminals 20 and a bridge member 25 for establishing electrical connection between the switch terminals 20. Each switch terminal 20 has a base 21 forming barbs (not labeled) on lateral sides thereof, a connecting end 22 extending from the base 21, a curved actuating section 23 extending from the base 21 opposite the connecting end 22, and a contact section 24 extending from the actuating section 23 opposite the connecting end 22.

The switch terminals 20 can be designed to be substantially identical to the contacts 12 thereby simplifying the manufacturing process of the card connector 1 and decreasing the cost thereof.

In assembly, the bases 21 of the switch terminals 20 are snugly received within the corresponding switch receiving cavities 125, 126, whereby the barbs have an interferential fit with the housing 10. The connecting ends 22 of the switch terminals 20 extend into the rectangular aperture 127 of the housing 10 for being soldered to corresponding circuitry of a printed circuit board (not shown) on which the card connector 1 is mounted. The curved actuating sections 23 of the switch terminals 20 extend beyond the base plate 100 for engaging with an electrical card 3. The bridge member 25 is positioned within the recess 128 of the housing 10.

The switch device 2 can be designed to be either normally open or normally closed. In the preferred first embodiment, the switch 2 is designed to be normally closed. The contact sections 24 of the switch terminals 20 are extended under the bridge member 25 and normally abut against an underside of the bridge member 25. When the electrical card 3 is inserted into the card connector 1, the card 3 presses the actuating sections 23 of the switch terminals 20 downward so as to disengage the contact sections 24 from the bridge member 25. Thus, the electrical connection between the switch terminals 20 via the bridge member 25 is broken thereby opening a circuit in a switch circuitry (not shown) on the PCB which indicates that the card 3 is inserted into the connector 3.

Figure 5:
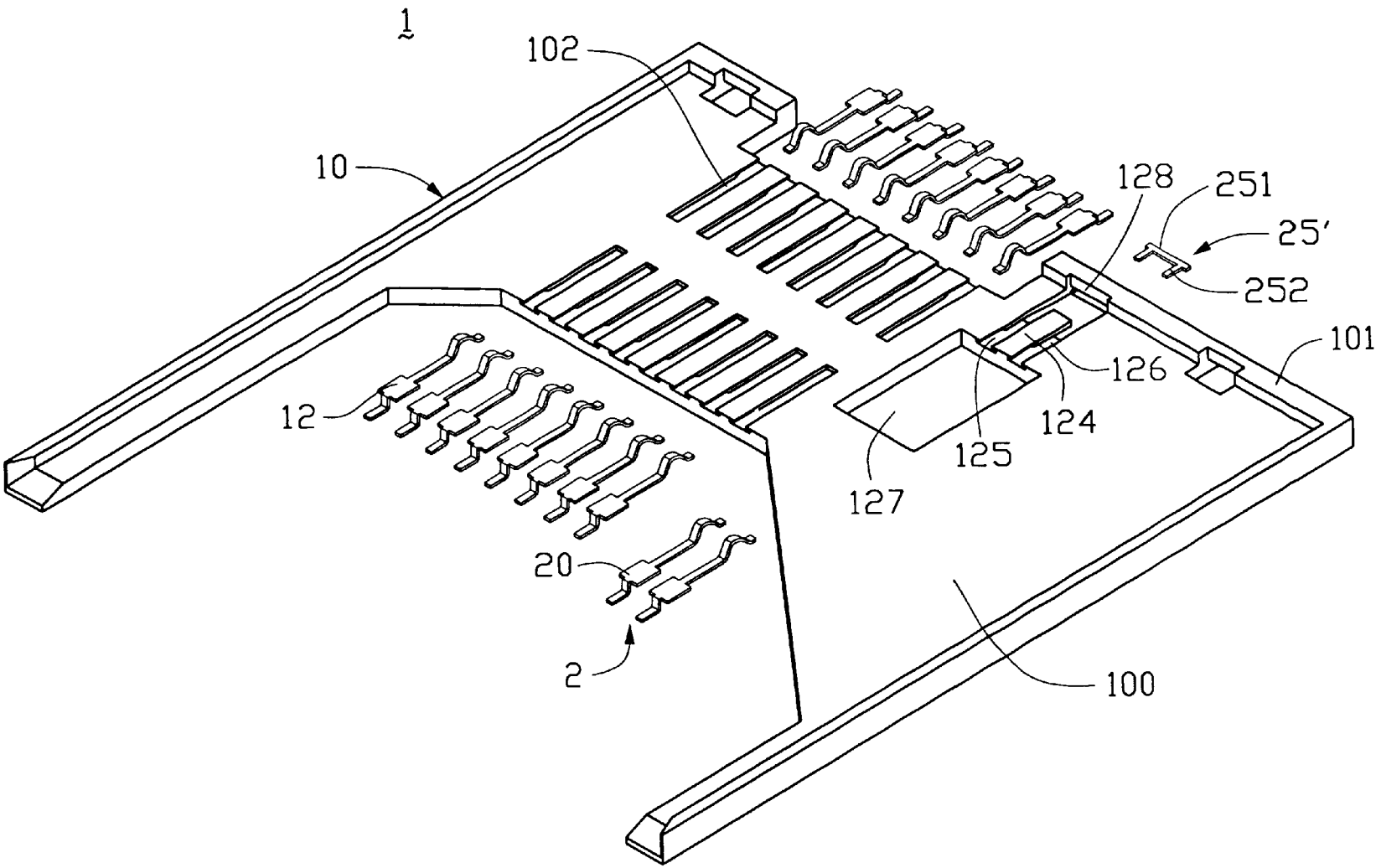
FIG. 5 is an exploded view of a electrical card connector in accordance with a second embodiment of the present invention.
Figure 6:
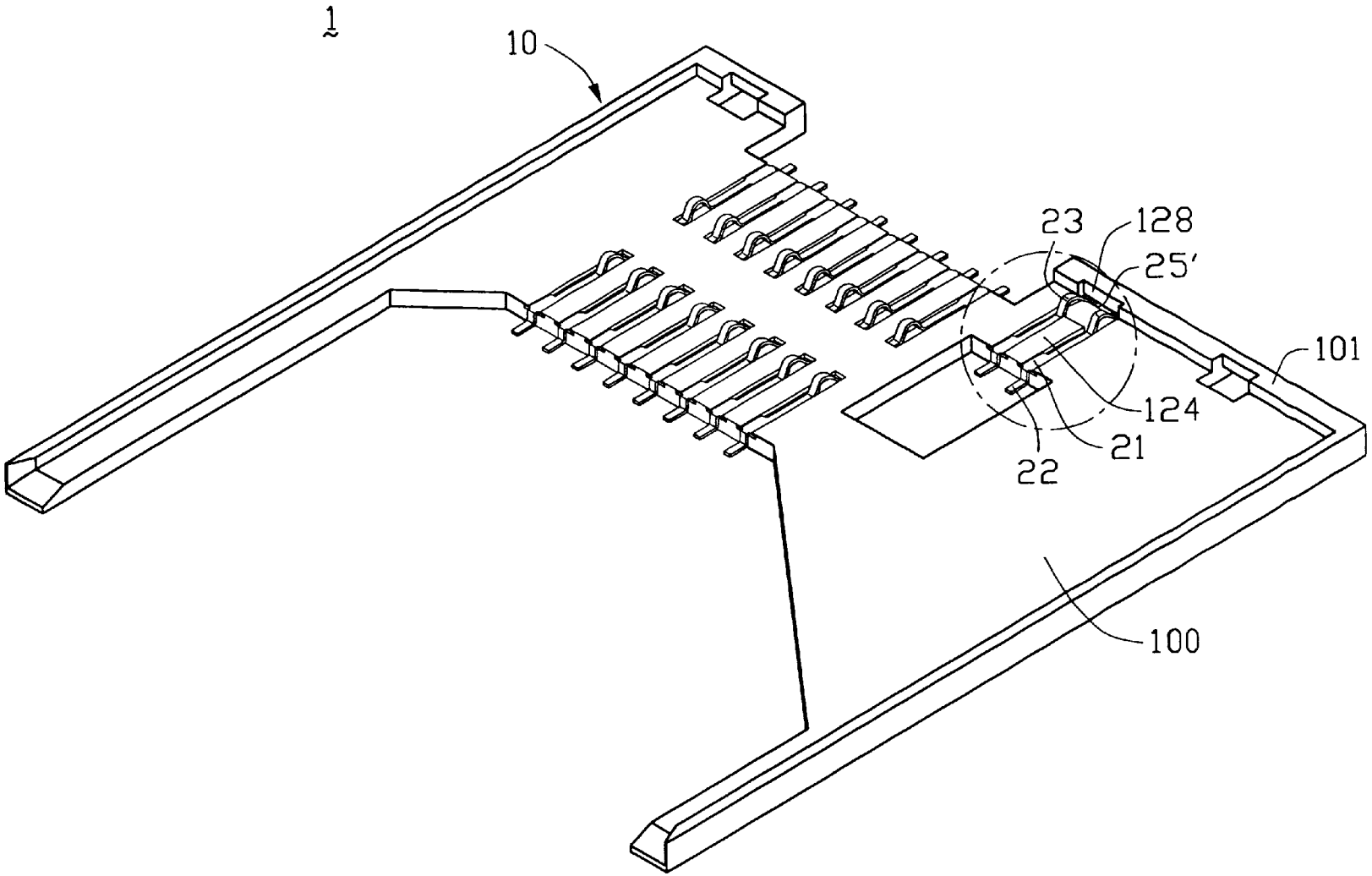
FIG. 6 is an assembled view of FIG. 5.
Figure 7:
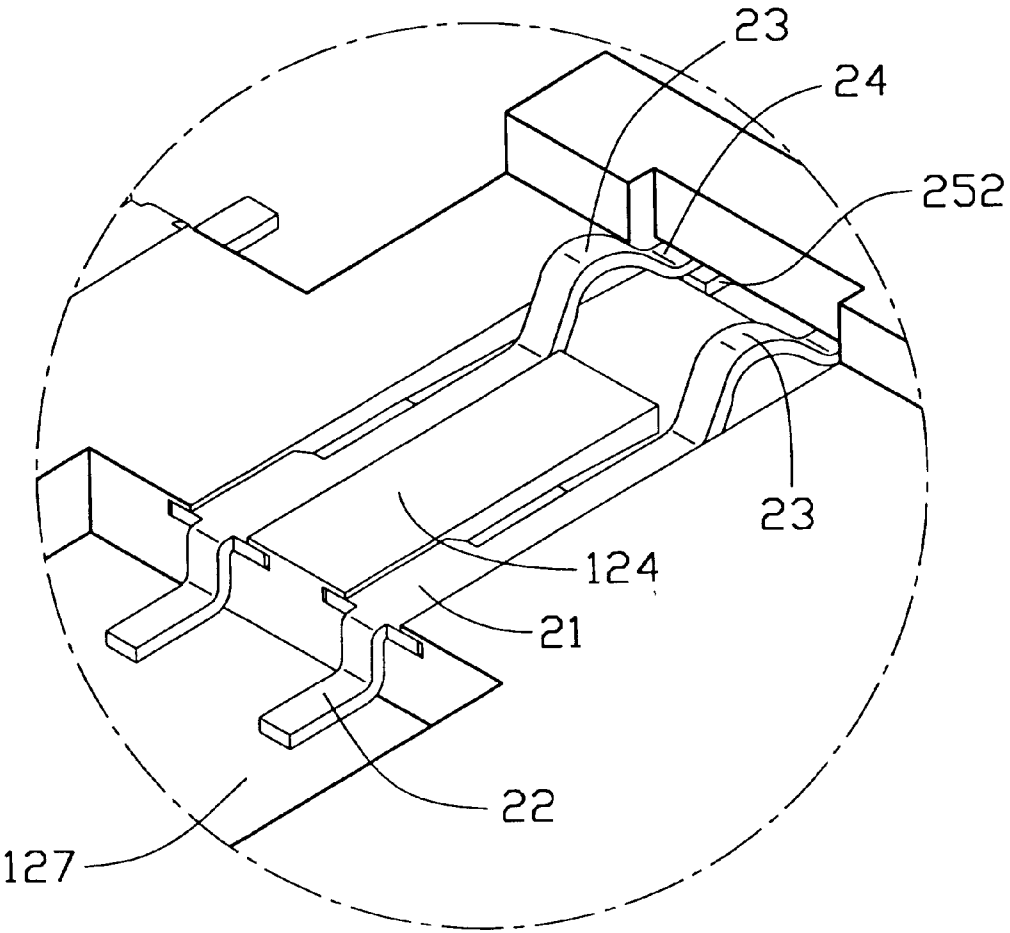
FIG. 7 is a partially enlarged view of a switch device of FIG. 5.
Figure 8:
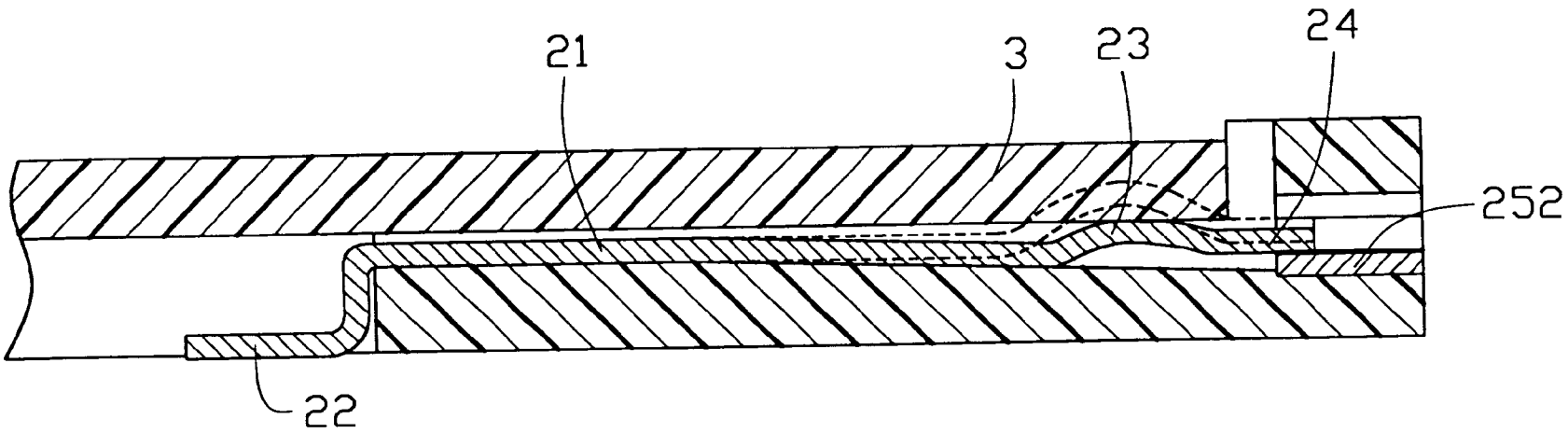
FIG. 8 is a partially cross-sectional view of FIG. 6 showing the switch device engaging with an electrical card inserted into the smart connector.

Referring further to FIGS. 5–8, a second preferred embodiment is shown. In the second embodiment, the switch 2 is designed to be a normally open switch. The bridge member 25' is positioned below the switch terminals 20 a pre-determined distance. When the card 3 is inserted, the actuating sections 23 of the switch terminals 20 are forced to move downwardly so that the contact sections 24 come into electrical contact with the bridge member 25'. Thus, the switch device 2 performs its switching function by closing a circuit in switch circuitry (not shown) on the PCB which indicates that the card 3 is inserted into the connector.

The configuration of the bridge member can be altered according to practical requirements. In the first preferred embodiment, the bridge member 25 is an elongate planar plate, while the bridge member 25' in the second preferred embodiment is designed to form an elongate body 251 and a pair of arms 252 protruding from the elongate body 251 for electrically engaging with the contact sections 24 of the corresponding switch terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What we claim is:

1. An electrical card connector adapted to engage with an electrical card, comprising:

an insulative housing retaining a plurality of contacts therein;

a switch device retained within the housing and including a pair of switch terminals having the same configuration and a bridge member; wherein the switch device indicates whether the electrical card is inserted into the card connector by an electrical engagement/disengagement between the switch terminals and the bridge member;

wherein the switch terminal and the contacts have the same configuration;

wherein the housing defines a pair of switch receiving cavities for respectively receiving the switch terminals, and a recess in communication with both switch receiving cavities for receiving the bridge member;

wherein the housing forms an end wall at an end thereof, the recess being defined in the end wall and the switch receiving cavities being adjacent to the recess;

wherein each switch terminal has a base with barbs on lateral sides thereof, a curved actuating section extending from the base for engaging with the electrical card when the electrical card is inserted, a contact section extending from the actuating section for electrically contacting the bridge member, and a connecting end extending from the base opposite to the contact section.

2. The electrical card connector as claimed in claim 1, wherein the switch is a normally open switch.

3. The electrical card connector as claimed in claim 1, wherein the switch is a normally closed switch.

4. The electrical card connector as claimed in claim 1, wherein the bridge member of the switch device is partially positioned under the switch terminals so that the switch terminals will be forced by the electrical card to downwardly move to electrically contact the bridge member when the electrical card is inserted into the card connector to engage with the switch terminals.

5. The electrical card connector as claimed in claim 1, wherein the bridge is positioned above the switch terminals and engages with the switch terminals when the electrical card is not inserted in the card connector, so that the switch terminals will be forced to downwardly move thereby disengaging with the bridge member when the electrical card is inserted into the card connector to engage with the switch terminals.

6. The electrical card connector as claimed in claim 1, wherein the bridge member is designed in a planar plate shape when positioned to electrically engage with the switch terminals before the insertion of the electrical card.

7. The electrical card connector as claimed in claim 1, wherein the bridge member is designed to form a body and a pair of arms laterally extending from the body for electrically contact the switch terminals upon insertion of the electrical card, and wherein the bridge member is positioned to be disengaged from the switch terminals before the insertion of the electrical card.

* * * * *